US005303444A

United States Patent [19]

Sebor

[11] Patent Number: 5,303,444

[45] Date of Patent: Apr. 19, 1994

[54] RIGID SKIRT FOR BRISTLES OF SUBMERSIBLE SUCTION CLEANER

[76] Inventor: Pavel Sebor, 45 Highcliff Way, Northcliff Extension 12, Johannesburg, Transvall, South Africa

[21] Appl. No.: 880,664

[22] Filed: May 11, 1992

[30] Foreign Application Priority Data

Feb. 28, 1992 [ZA] South Africa ..... 92/1501

[51] Int. Cl.[5] ..... E04H 3/20

[52] U.S. Cl. ..... 15/1.7; 15/400

[58] Field of Search ..... 15/1.7, 398, 399, 400

[56] References Cited

U.S. PATENT DOCUMENTS

| | | | |
|---|---|---|---|
| 2,085,701 | 6/1937 | Kitto | 15/399 |
| 2,869,170 | 1/1959 | Wessel | 15/399 |
| 2,974,348 | 3/1961 | Wessel | 15/399 |
| 4,498,206 | 2/1985 | Braukmann | 15/1.7 |
| 4,692,956 | 9/1987 | Kassis | 15/1.7 |
| 4,962,559 | 10/1990 | Schuman | 15/1.7 |

FOREIGN PATENT DOCUMENTS

| | | | |
|---|---|---|---|
| 767648 | 5/1934 | France | 15/399 |

*Primary Examiner*—Harvey C. Hornsby
*Assistant Examiner*—Gary K. Graham
*Attorney, Agent, or Firm*—Allen, Dyer, Doppelt, Franjola & Milbrath

[57] ABSTRACT

The invention provides an automatic swimming pool cleaner which is self propelled over underwater surfaces by a pivoting oscillator. The pool cleaner includes a row of bristles extending from the housing from scrubbing the surfaces to be cleaned. Surrounding the row of bristles is a skirt extending from the housing. The skirt is tapered along its length, relative to the bristles, to control the flow of water through the pool cleaner and thus provide effective movement of the cleaner.

4 Claims, 1 Drawing Sheet

RIGID SKIRT FOR BRISTLES OF SUBMERSIBLE SUCTION CLEANER

BACKGROUND OF THE INVENTION

This invention elates to self-propelled submersible suction cleaners, particularly swimming pool suction cleaners. The term "self-propelled" herein means that the suction cleaner is not manually propelled but incorporates means, such as an oscillator, operated by the flow of water through the suction head, to cause propulsion of the device.

Suction cleaners of the above kind usually incorporate a polymer skirt or base on which a housing for the propulsion mechanism rests. The skirt plays a part in the sweeping action of the device and also in its forward movement under the action of the propulsion mechanism. As an alternative to the use of a skirt, the housing or suction head may rest on bristles mounted on the head and projecting downwardly therefrom around the periphery of a mouth of the head. The bristles operate as a spring cushion to enhance the propulsion motion of the device but it is necessary to provide a skirt around the bristles in order to regulate the flow of water therethrough. Without the control of flow through the bristles the flow is spaced too far upwardly from the swept surface and the sweeping action is rendered inefficient.

SUMMARY OF THE INVENTION

It is an object of the invention to provide a suction cleaner in which the suction head is supported on bristles which operate efficiently as a spring cushion in the propulsion action and also in directing the flow of water into the suction head for efficient sweeping action.

According to the invention a self-propelled submersible suction cleaner includes a head having a downwardly directed mouth for location adjacent a submersible surface to be swept, bristles disposed around the mouth and extending downwardly therefrom on which the suction head rests, an external skirt which extends around the bristles and which is shorter at the front of the head than at the rear thereof so that the bristles project beyond the skirt to a greater extent at the front of the skirt than at the rear thereof, and an internal skirt disposed behind the bristles at the front thereof, the bristles projecting downwardly beyond the internal skirt, and the internal and external skirts operating to direct flow into the head around the free edges of the skirts.

Further according to the invention the external skirt is tapered, in a peripheral sense, from the rear of the head to the front thereof, and the internal skirt extends from the side to side across the front of the head, the internal skirt being spaced laterally inwardly and the external skirt laterally outwardly from the bristles.

In a preferred embodiment of the invention the internal skirt comprises an integral part of the upper housing formed by a suitable moulting technique.

BRIEF DESCRIPTION OF THE DRAWINGS

In order to illustrate the invention an example is described below with reference to the accompanying drawings in which.

DETAILED DESCRIPTION OF THE PREFERRED EMBODIMENT

Figure 1:
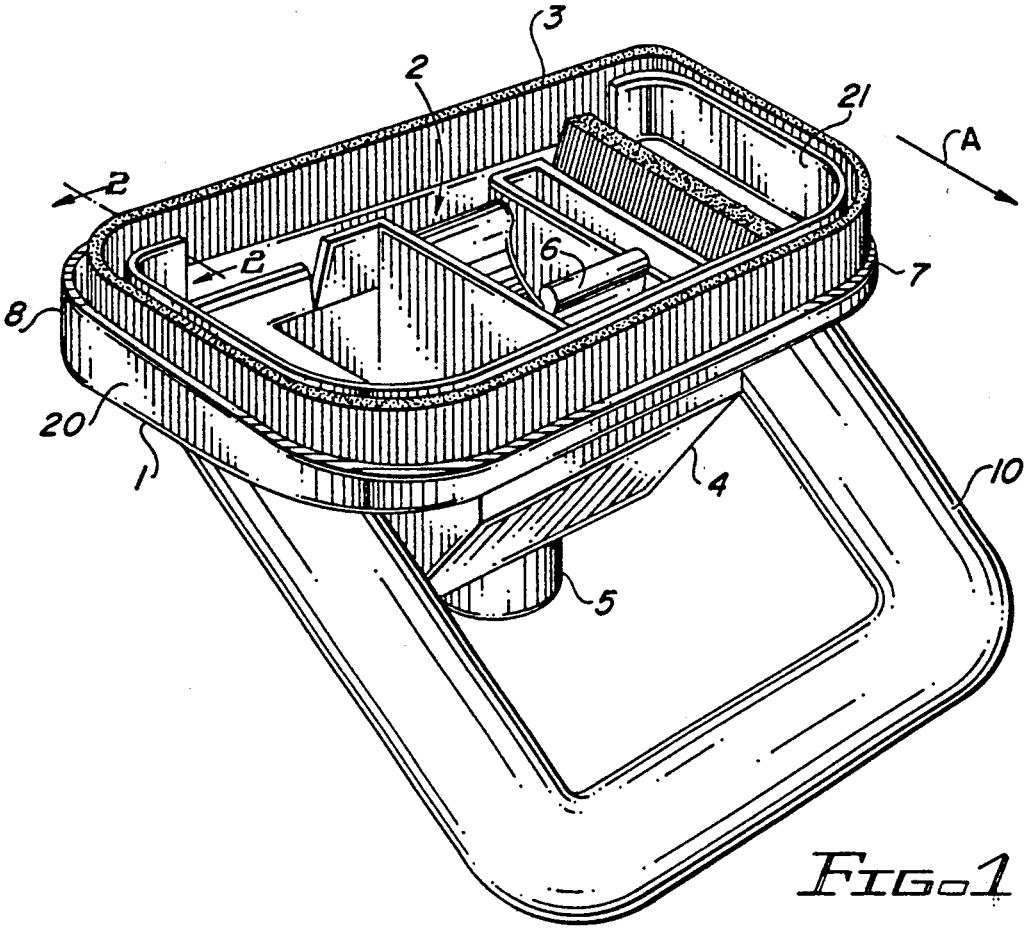
FIG. 1 is a perspective view from the bottom of a self-propelled submersible suction cleaner head.
Figure 2:
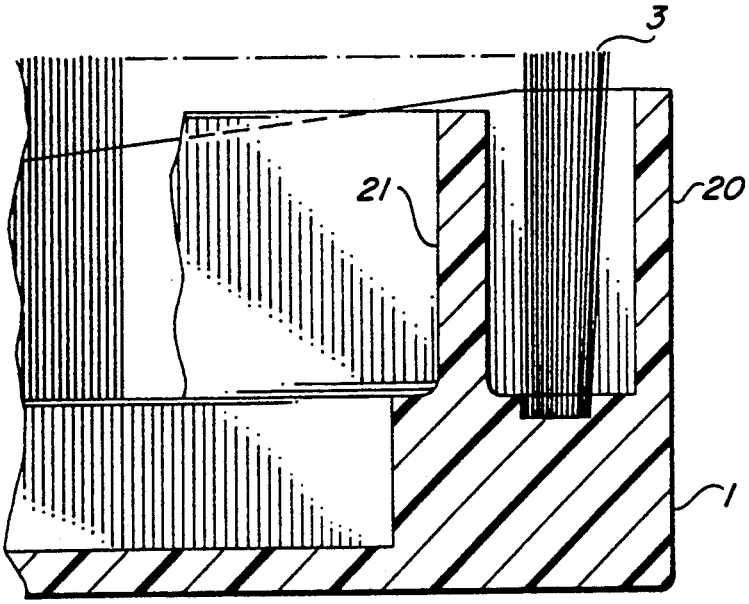
FIG. 2 is a section taken on the line II—II in FIG. 1.

Referring to the drawings, the suction head of the suction cleaner comprises a substantially rectangular body or housing 1 of suitable polymer material having a downwardly directed mouth 2 around which are located bristles 3 on which the head rests. The body of the suction head defines a suction chamber 4 provided with a coupling 5 to which a suction hose (not shown) may be connected.

An oscillator 6 is located within the suction chamber 4 for operation by flow of water therepast caused by coupling of the suction chamber to a pump by the suction hose. The oscillator 6 pivots to and fro on it mounting under the action of the flow of water therepast, and in doing so it impacts on the body 1, causing a jerking motion of the head which is translated into forward motion by the spring cushion bristle action.

Operation of the oscillator therefore acts as a propelling mechanism for the suction head which moves in the direction of arrow A so that the side 7 of the suction head comprises the front and side 8 the rear thereof.

The body 1 of the suction cleaner head defines external skirt means 20 adjacent bristles 3 which project downwardly beyond skirt 20. This external skirt 20 is tapered in a peripheral sense from the rear side 8 to the front side 7 of the suction head so that the bristles 3 are almost fully exposed at the front 7 of the head but project only slightly beyond skirt 20 at the rear of the head.

An internal skirt portion 21 moulded integrally with the polymer housing 1 is located adjacent the bristles and internally thereof and extends from one side of the head to the other along the front thereof. Both the external skirt 20 and internal skirt 21 are laterally spaced from bristles 3 so that the latter are able to flex under the hammer action of the oscillator 6 to provide an effective spring cushion enhancing the propulsion action of the oscillator.

It will be appreciated that in operation flow of water into the head is directed around the free edges of the internal and external skirts so that an efficient sweeping action is provided by the head on a submerged surface engaged by the suction cleaner of the invention.

What is claimed is:

1. An automatic swimming pool cleaner comprising:

an elongated housing having spaced front and rear longitudinal sides and a top and bottom, said housing further having an internal suction chamber therein which fluidly communicates with an opening provided in said bottom and a coupling provided on said top, said coupling adapted for connecting the suction chamber to a suction source;

means pivotally mounted to the housing, within the suction chamber, responsive to a flow of water through said suction chamber, to thereby impart a jerking impact against the housing;

a continuous row of bristles extending laterally from the bottom of the housing, surrounding the opening;

an external skirt extending laterally from the bottom of the housing, surrounding said row of bristles and the opening;

said row of bristles extends to a greater length from said housing than said skirt; and wherein the relative dimension between the extremity of the external skirt and the ends of the bristles decreases about the opening from the front side to the rear side.

2. The automatic swimming pool cleaner recited in claim 1 wherein the pivoting means comprises a curved oscillator pivotally mounted in the suction chamber in the water flow through the suction chamber.

3. The automatic swimming pool cleaner recited in claim 1 further comprising an internal skirt extending laterally from the bottom of the housing, surrounding at least a portion of the opening and provided inwardly of said row of bristles to sandwich said row of bristles between said skirts.

4. The automatic swimming pool cleaner recited in claim 3 wherein the external and internal skirts are spaced from the row of bristles a sufficient dimension so as to permit the bristles to freely flex.

* * * * *

UNITED STATES PATENT AND TRADEMARK OFFICE
Certificate

Patent No. 5,303,444 Patented: April 19, 1994

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Pavel Sebor, Johannesburg, Transvall, South Africa; and Dieter J. Rief, Santa Rosa, CA.

Signed and Sealed this Thirteenth Day of September 2005.

JILL WARDEN
*Supervisory Patent Examiner*
Art Unit 1743